US009954288B2

(12) United States Patent
Luk et al.

(10) Patent No.: US 9,954,288 B2
(45) **Date of Patent: *Apr. 24, 2018**

(54) WAVEGUIDE FED AND WIDEBAND COMPLEMENTARY ANTENNA

(71) Applicant: City University of Hong Kong, Kowloon (HK)

(72) Inventors: Kwai-Man Luk, Kowloon (HK); Yujian Li, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 15/594,730

(22) Filed: May 15, 2017

(65) Prior Publication Data

US 2017/0250473 A1 Aug. 31, 2017

Related U.S. Application Data

(63) Continuation of application No. 14/738,299, filed on Jun. 12, 2015, now Pat. No. 9,563,810.

(51) Int. Cl.
*H01Q 9/28* (2006.01)
*H01Q 21/06* (2006.01)
*H01Q 9/06* (2006.01)

(52) U.S. Cl.
CPC ..... *H01Q 21/062* (2013.01); *H01Q 9/065* (2013.01); *H01Q 9/285* (2013.01); *H01Q 21/065* (2013.01)

(58) Field of Classification Search
CPC ..... H01Q 9/065; H01Q 9/0407
USPC ..... 343/795, 792, 797, 857
See application file for complete search history.

(56) References Cited

U.S. PATENT DOCUMENTS

| | | | | |
|---|---|---|---|---|
| 3,594,806 A | | 7/1971 | Black et al. | |
| 4,414,550 A | | 11/1983 | Tresselt | |
| 4,879,563 A | | 11/1989 | Takeda et al. | |
| 5,754,145 A | * | 5/1998 | Evans | H01Q 9/18 343/727 |
| 5,917,458 A | | 6/1999 | Ho et al. | |
| 6,014,112 A | * | 1/2000 | Koscica | H01Q 1/246 343/700 MS |

(Continued)

OTHER PUBLICATIONS

Miura, et al. "Double-Layer Full-Corporate-Feed Hollow-Waveguide Slot Array Antenna in the 60-GHz Band," IEEE Trans. Antennas Propag., vol. 59, No. 8, pp. 2844-2854, Aug. 2011.

(Continued)

*Primary Examiner* — Jean B Jeanglaude
(74) *Attorney, Agent, or Firm* — Amin, Turocy & Watson, LLP

(57) ABSTRACT

A complementary antenna (e.g., wideband complementary antenna) is presented herein. A complementary antenna can include a first dipole portion, a second dipole portion, a first electrically conductive surface, and a second electrically conductive surface. The first dipole portion can include a first patch antenna portion and a second patch antenna portion. The second dipole portion can include a third patch antenna portion and a fourth patch antenna portion electrically coupled to the second patch antenna portion via a strip antenna portion. The first electrically conductive surface can be coupled to the first dipole portion and the second dipole portion via a first set of electrically conductive pins. The second electrically conductive surface can be coupled to the first electrically conductive surface via a second set of electrically conductive pins.

20 Claims, 21 Drawing Sheets

(56) References Cited

U.S. PATENT DOCUMENTS

| | | | |
|---|---|---|---|
| 6,342,868 | B1 | 1/2002 | Tsai et al. |
| 6,992,628 | B2 | 1/2006 | Rawnick et al. |
| 7,843,389 | B2 | 11/2010 | Luk et al. |
| 9,083,086 | B2 | 7/2015 | Chan |
| 2005/0212713 | A1 | 9/2005 | Dai |
| 2007/0013575 | A1 | 1/2007 | Lee |
| 2010/0002620 | A1 | 1/2010 | Proctor |
| 2011/0128202 | A1 | 6/2011 | Ju |
| 2012/0032869 | A1 | 2/2012 | Hawkins |
| 2015/0214634 | A1 | 7/2015 | Lee |

OTHER PUBLICATIONS

Wang, et al. "Wideband high-gain 60-GHz LTCC L-probe patch antenna array with a soft surface," IEEE Trans. Antennas Progag., vol. 61 , No. 4, pp. 1802-1809, Apr. 2013.

Sun, et al. "60-GHz Circularly Polarized U-Slot Patch Antenna Array on LTCC," IEEE Trans. Antennas Progag., vol. 61 , No. I, pp. 430-435, Apr. 2013.

Lamminen, et al. "60 GHz patch antennas and arrays on LTCC with embedded cavity substrates," IEEE Trans. Antennas Progag., vol. 56, No. 9, pp. 2865-2874, Sep. 2008.

Li, et al. "Low-cost High-gain and Broadband Substrate Integrated Waveguide Fed Patch Antenna Array for 60-GHz Band," IEEE Trans. Antennas Propag., Accepted for publication. Oct. 2014.

Xu, et al. "Bandwidth enhancement for a 60 GHz substrate integrated waveguide fed cavity array antenna on LTCC," IEEE Trans. Antennas Progag., vol. 59, No. 3, pp. 826-832, Mar. 2011.

Ng, et al. "60 GHz plated through hole printed magneto-electric dipole antenna," IEEE Trans. Antennas Progag., vol. 60, No. 7, pp. 3129-3136, Jul. 2012.

Office Action for U.S. Appl. No. 14/738,299 dated Aug. 30, 2016, 17 pages.

* cited by examiner

1900

2000

2100

WAVEGUIDE FED AND WIDEBAND COMPLEMENTARY ANTENNA

CROSS REFERENCE TO RELATED APPLICATIONS

This application is a continuation of, and claims priority to, U.S. patent application Ser. No. 14/738,299, filed on Jun. 12, 2015, entitled "WAVEGUIDE FED AND WIDEBAND COMPLEMENTARY ANTENNA." The entirety of the foregoing listed application is hereby incorporated by reference herein.

TECHNICAL FIELD

The subject disclosure generally relates to embodiments for a waveguide fed and wideband complementary antenna.

BACKGROUND

Conventional antenna technologies including slot antennas, patch antennas, and dielectric loaded cavity radiators are often employed for antenna applications (e.g., millimeter-wave antenna applications, etc.). However, such technologies have had some drawbacks, some of which may be noted with reference to the various embodiments described herein below.

BRIEF DESCRIPTION OF THE DRAWINGS

Non-limiting embodiments of the subject disclosure are described with reference to the following figures, wherein like reference numerals refer to like parts throughout the various views unless otherwise specified.

DETAILED DESCRIPTION

Figure 1:
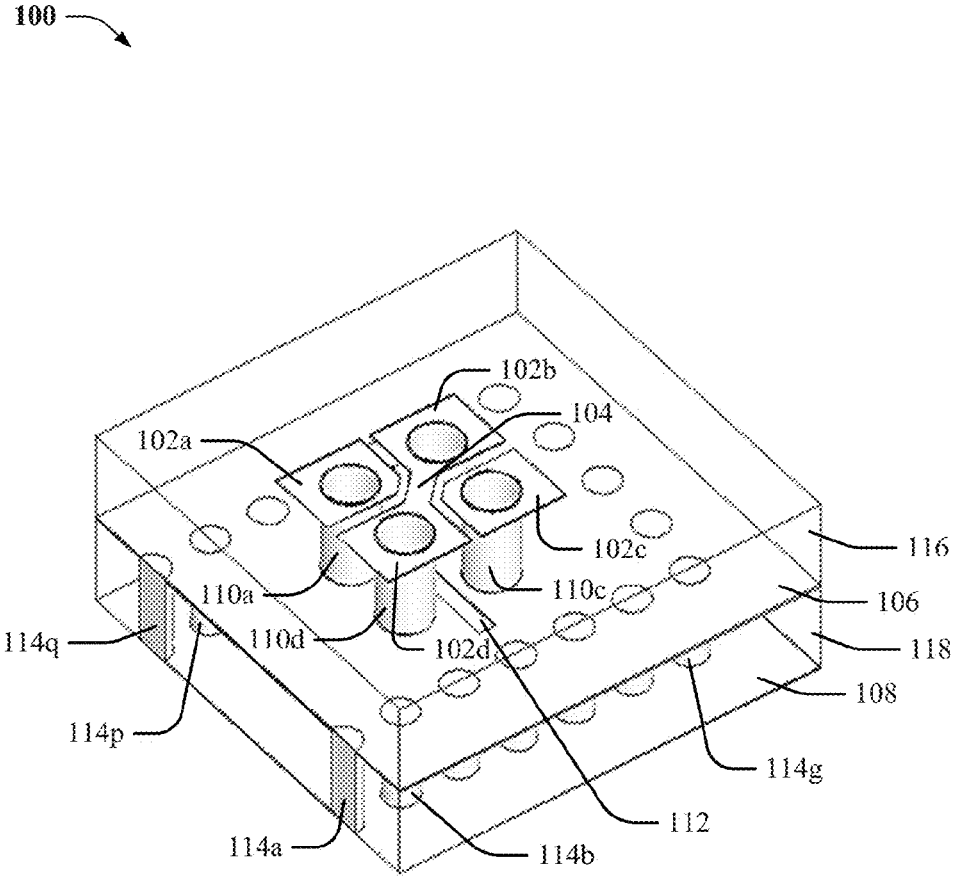
FIG. 1 illustrates a perspective view of an exemplary antenna, in accordance with various embodiments.

Aspects of the subject disclosure will now be described more fully hereinafter with reference to the accompanying drawings in which example embodiments are shown. In the following description, for purposes of explanation, numerous specific details are set forth in order to provide a thorough understanding of the various embodiments. However, the subject disclosure may be embodied in many different forms and should not be construed as limited to the example embodiments set forth herein.

Conventional antenna technologies (e.g., conventional slot antennas, conventional patch antennas, conventional dielectric loaded cavity radiators, etc.) have some drawbacks with respect to certain antenna applications (e.g., millimeter-wave antenna applications, etc.). For example, an operating bandwidth for a conventional slot antenna is generally not wideband and a beamwidth for a conventional slot antenna is generally not suitable for applications in antenna arrays. Furthermore, conventional patch antennas generally comprise a complex structure and are generally difficult to fabricate at millimeter-wave frequencies. Moreover, it is generally difficult to employ conventional dielectric loaded cavity radiators in antenna array designs due to the relatively large size of conventional dielectric loaded cavity radiators compared to wavelength (e.g., if a dielectric material with high relative permittivity is not used).

To these and/or related ends, various embodiments disclosed herein provide for an improved antenna (e.g., an improved wideband complementary antenna) that can be employed in, for example, millimeter-wave antenna applications. In an aspect, an antenna (e.g., an wideband complementary antenna) can include a set of patch sections (e.g., four horizontal patch sections) and a set of metallic pins (e.g., four vertical metallic pins). The set of patch sections and the set of metallic pins can be integrated in a single-layered substrate. The set of patch sections can be configured as two planar dipoles. In one example, the four patch sections can be formed on (e.g., printed on, etc.) a top surface of a dielectric substrate. In another example, the set of metallic pins can be configured as two vertical shorted patches. An antenna structure can be excited by a substrate integrated waveguide (SIW) constructed in a dielectric substrate below the antenna structure. For example, the antenna (e.g., the wideband complementary antenna) can be excited by a coupling aperture etched on a SIW. Furthermore, an aperture etched on a top metallic clad surface (e.g., a top copper clad surface, etc.) of the SIW can be employed for coupling a signal (e.g., an input signal) from the SIW to the antenna structure. As such, an antenna (e.g., a wideband complementary antenna) with improved electrical characteristics (e.g., wide impedance bandwidth, symmetrical and/or stable radiation patterns at different frequencies over an operating bandwidth, low back radiation, low cross polarization, high and/or stable gain, etc.) can be provided. The antenna (e.g., the wideband complementary antenna) can also be associated with a simple radiating and feeding structure (e.g., an improved feeding technique), a low profile, a light weight design and/or a wide operating bandwidth. Therefore, the antenna (e.g., the wideband complementary antenna) can be less difficult to fabricate and/or can be suitable for designing high performance antenna arrays.

In an embodiment, a complementary antenna includes a first dipole portion, a second dipole portion, a first electrically conductive surface, and a second electrically conductive surface. The first dipole portion can include a first patch antenna portion and a second patch antenna portion. The second dipole portion can include a third patch antenna portion and a fourth patch antenna portion electrically coupled to the second patch antenna portion via a strip antenna portion. The first electrically conductive surface can be coupled to the first dipole portion and the second dipole portion via a first set of electrically conductive pins. The second electrically conductive surface can be coupled to the first electrically conductive surface via a second set of electrically conductive pins.

In another embodiment, a system includes an antenna and a substrate integrated waveguide. The antenna can include a first dipole portion, a second dipole portion and a first set of conductive pins. The first dipole portion can include a first antenna portion and a second antenna portion. The second dipole portion can include a third antenna portion and a fourth antenna portion attached to the second antenna portion via a fifth antenna portion. The substrate integrated waveguide can include a second set of conductive pins coupled to the antenna via an aperture etched on a first conductive surface.

In yet another embodiment, an antenna system includes a first substrate and a second substrate. The first substrate can include a first set of patch antenna sections, a second set of patch antenna sections attached via a strip antenna section, and a first set of metal pins. The second substrate can include a second set of metal pins attached to the first substrate via a first metal surface.

Reference throughout this specification to "one embodiment," or "an embodiment," means that a particular feature, structure, or characteristic described in connection with the embodiment is included in at least one embodiment. Thus, the appearances of the phrase "in one embodiment," or "in an embodiment," in various places throughout this specification are not necessarily all referring to the same embodiment. Furthermore, the particular features, structures, or characteristics may be combined in any suitable manner in one or more embodiments.

To the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Further, the word "exemplary" and/or "demonstrative" is used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art having the benefit of the instant disclosure.

Conventional antenna technologies have some drawbacks with respect to certain antenna applications (e.g., millimeter-wave antenna applications, etc.). On the other hand, various embodiments disclosed herein provide for an improved antenna (e.g., an improved wideband complementary antenna) that can be employed in, for example, millimeter-wave antenna applications. In this regard, and now referring to FIG. 1, a perspective view of an antenna 100 is illustrated, in accordance with various embodiments. The antenna 100 can be, for example, a wideband complementary antenna, a millimeter-wave antenna, a microwave antenna, another type of antenna, etc. In one example, the antenna 100 can be employed in a millimeter-wave communication system. In one example, the antenna 100 can be employed in a microwave communication system. In yet another example, the antenna 100 can be employed for planar antenna arrays working at millimeter-wave frequencies (e.g., the antenna 100 can be implemented in an antenna system that includes multiple planar antenna arrays with multiple parallel feed networks, etc.).

The antenna 100 includes patch antenna portions 102*a-d* (e.g., a first patch antenna portion 102*a*, a second patch antenna portion 102*b*, a third patch antenna portion 102*c*, and a fourth patch antenna portion 102*d*). The first patch antenna portion 102*a* and the second patch antenna portion 102*b* can be associated with a first dipole portion (e.g., a first electric dipole). The third patch antenna portion 102*c* and the fourth patch antenna portion 102*d* can be associated with a second dipole portion (e.g., a second electric dipole). The fourth antenna portion 102*d* can be electrically coupled to the second patch antenna portion 102*b* via a strip antenna portion 104. The first patch antenna portion 102*a* can correspond to the third patch antenna portion 102*c*. For example, a size of the first patch antenna portion 102*a* can correspond to a size of the third patch antenna portion 102*c*. Furthermore, the second patch antenna portion 102*b* can correspond to the fourth patch antenna portion 102*d*. For example, a size of the second patch antenna portion 102*b* can correspond to a size of the fourth patch antenna portion 102*d*. In the implementation shown in FIG. 1, the first patch antenna portion 102*a* and the third patch antenna portion 102*c* can comprise a smaller surface area than the second patch antenna portion 102*b* and the fourth patch antenna portion 102*d*. For example, a particular corner of the first patch antenna portion 102*a* and the third patch antenna portion 102*c* (e.g., an inner corner associated with the strip antenna portion 104 electrically coupled to the second patch antenna portion 102*b* and the fourth antenna portion 102*d*) can be removed from the first patch antenna portion 102*a* and the third patch antenna portion 102*c*.

The antenna 100 also includes a first electrically conductive surface 106 and a second electrically conductive surface 108. In one example, the first electrically conductive surface 106 can be implemented as a metallic clad surface (e.g., a copper clad surface, etc.) and/or the second electrically conductive surface 108 can be implemented as a metallic clad surface (e.g., a copper clad surface, etc.). The first electrically conductive surface 106 can be coupled to the first dipole portion (e.g., the first patch antenna portion 102*a* and the second patch antenna portion 102*b* associated with the first dipole portion and the second dipole portion) via a first set of electrically conductive pins 110*a-d*. For example, a first electrically conductive pin 110*a* can be coupled to the first patch antenna portion 102*a*, a second electrically conductive pin 110*b* can be coupled to the second patch antenna portion 102*b*, a third electrically conductive pin 110*c* can be coupled to the third patch antenna portion 102*c*, and a fourth electrically conductive pin 110*d* can be coupled to the fourth patch antenna portion 102*d*. The first set of electrically conductive pins 110*a-d* can be implemented as, for example, a set of vias (e.g., a set of electrical connections).

The first electrically conductive surface 106 can include an aperture 112 etched on the first electrically conductive surface 106. In one example, the aperture 112 can be a transverse aperture. In another example, the aperture 112 can be an offset longitudinal aperture. In an aspect, the first electrically conductive pin 102*a* and the fourth electrically conductive pin 102*d* can be separated from the second electrically conductive pin 102*b* and the third electrically conductive pin 102*c* via the aperture 112 etched on the first electrically conductive surface 106. In another aspect, the first electrically conductive pin 102*a* and the second electrically conductive pin 102*b* can be separated from the third electrically conductive pin 102*c* and the fourth electrically conductive pin 102*d* via the aperture 112 etched on the first electrically conductive surface 106. The second electrically conductive surface 108 can be coupled to the first electrically conductive surface 106 via a second set of electrically conductive pins 114*a-q*. The second set of electrically conductive pins 114*a-q* can be implemented as, for example, a set of vias (e.g., a set of electrical connections). In an implementation, an electrically conductive pin 114*a* and an electrically conductive pin 114*q* included in the second set of electrically conductive pins 114*a-q* can correspond to half an electrically conductive pin, while electrically conductive pins 114*b-p* can correspond to a full electrically conductive pin. In another implementation, each electrically conductive pin included in the second set of electrically conductive pins 114*a-q* can correspond to a full electrically conductive pin. In yet another implementation, an opening for a U-shaped arrangement of the second set of electrically conductive pins 114*a-q* can be associated with the first patch antenna portion 102*a* and the fourth patch antenna portion 102*d*.

A first substrate 116 can include the first patch antenna portion 102*a* and the second patch antenna portion 102*b* associated with the first dipole portion, the third patch antenna portion 102*c* and the fourth patch antenna portion 102*d* associated with the second dipole portion, and the first set of electrically conductive pins 110*a-d*. The first substrate 116 can be a single-layered substrate. As such, an antenna structure (e.g., the patch antenna portions 102*a-d* and the first set of electrically conductive pins 110*a-d*) can be integrated in a single-layered substrate (e.g., the first substrate 116). Furthermore, the first electrically conductive surface 106 and the second electrically conductive surface 108 can be separated by a second substrate 118. The second substrate 118 can include the second set of electrically conductive pins 114*a-q*. The second substrate 118 can also be a single-layered substrate. In one example, the first substrate 116 and/or the second substrate 118 can comprise polytetrafluoroethylene composite material and/or glass microfiber material. In a non-limiting example, the first substrate 116 and/or the second substrate 118 can include a thickness of 0.787 mm.

In an aspect, the first dipole portion (e.g., the first patch antenna portion 102*a* and the second patch antenna portion 102*b* associated with the first dipole portion) and the second dipole portion (e.g., the third patch antenna portion 102*c* and the fourth patch antenna portion 102*d* associated with the second dipole portion) can be electrically excited via the first electrically conductive surface 106 (e.g., the aperture 112 etched on the first electrically conductive surface 106 and/or the first set of electrically conductive pins 110*a-d* coupled to the first electrically conductive surface 106) and/or the second electrically conductive surface 108 (e.g., the second set of electrically conductive pins 114*a-q* coupled to the second electrically conductive surface 108). In another aspect, the first dipole portion (e.g., the first patch antenna portion 102*a* and the second patch antenna portion 102*b* associated with the first dipole portion) and the second dipole portion (e.g., the third patch antenna portion 102*c* and the fourth patch antenna portion 102*d* associated with the second dipole portion) can be electrically excited via a SIW (e.g., a shorted-end SIW) formed by the second set of electrically conductive pins 114*a-q* and a top and bottom surface of the second substrate 118 (e.g., the first electrically conductive surface 106 and the second electrically conductive surface 108). In yet another aspect, a signal (e.g., an input signal) can be coupled from the SIW (e.g., the shorted-end SIW) to the first dipole portion and the second dipole portion via the aperture etched on the first electrically conductive surface 106.

In another aspect, the antenna 100 can include an antenna (e.g., an antenna structure) associated with the first substrate 116 and an SIW (e.g., an SIW structure) associated with the second substrate 118. For example, the antenna (e.g., the antenna structure) associated with the first substrate 116 can include the first dipole portion, the second dipole portion and the first set of electrically conductive pins 110*a-d*. The first dipole portion can include the first patch antenna portion 102*a* (e.g., a first antenna portion) and the second patch antenna portion 102*b* (e.g., a second antenna portion). The second dipole portion can include the third patch antenna portion 102*c* (e.g., a third antenna portion) and the fourth patch antenna portion 102*d* (e.g., a fourth antenna portion). The fourth patch antenna portion 102*d* (e.g., the fourth antenna portion) can be attached to the second patch antenna portion 102*b* (e.g., the second antenna portion) via the strip antenna portion 104 (e.g., a fifth antenna portion). Additionally, the SIW (e.g., the SIW structure) associated with the second substrate 118 can include the second set of electrically conductive pins 114*a-q* that are coupled to the antenna (e.g., the antenna structure) associated with the first substrate 116 via at least the aperture 112 etched on the first electrically conductive surface 106 (e.g., a first conductive surface) and/or the second electrically conductive surface 108 (e.g., a second conductive surface).

The antenna 100 can be employed for antenna applications at various frequencies, such as but not limited to, a 38 GHz band, a 55 GHz band, a 60 GHz band, a 65 GHz band, a 77 GHz band, etc. Table I below defines values of geometrical parameters (e.g., E1, E2, Q, W, S3, H1, H2, A1, A2, D1, D2, L1, L2, G1, G2, G3, S1, S2, C1, C2, and P) associated with the antenna 100:

TABLE I

| Parameter | E1 | E2 | Q | W | S3 | H1 | H2 |
|---|---|---|---|---|---|---|---|
| Value | 5.0 mm | 5.0 mm | 2.1 mm | 3.15 mm | 0.7 mm | 0.787 mm | 0.787 mm |
| Parameter | A1 | A2 | D1 | D2 | L1 | L2 | G1 |
| Value | 2.2 mm | 0.2 mm | 0.55 mm | 0.4 mm | 0.8 mm | 0.97 mm | 0.15 mm |
| Parameter | G2 | G3 | S1 | S2 | C1 | C2 | P |
| Value | 0.12 mm | 0.09 mm | 0.85 mm | 1.0 mm | 0.18 mm | 0.18 mm | 0.25 mm |

As such, the antenna 100 (as well as other embodiments disclosed herein) can generate circularly polarized, linearly polarized, or dual polarized radiation. Furthermore, the antenna 100 (as well as other embodiments disclosed herein) can provide wide operating bandwidth, improved radiation performance, stable radiation performance, wide impedance bandwidth, symmetrical radiation patterns at different frequencies over an operating bandwidth, and stable radiation patterns at different frequencies over an operating bandwidth, low back radiation, low cross polarization, high gain, stable gain, and/or other improvements to electrical characteristics. Moreover, structure of the antenna 100 (as well as other embodiments disclosed herein) can facilitate less difficult design and/or fabrication using various fabrication technologies, such as but not limited to, a printed circuit board (PCB), low temperature co-fired ceramic (LTCC), liquid crystal polymer (LCP), etc.

Figure 2:
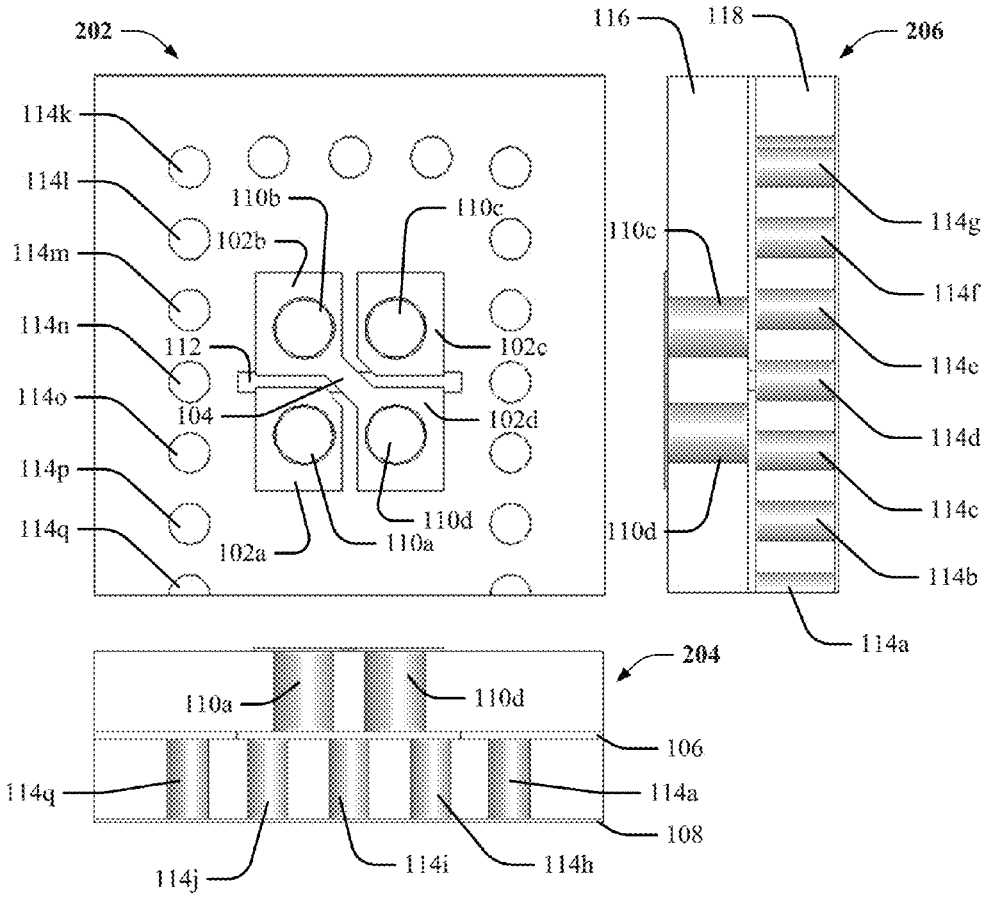
FIG. 2 illustrates a top view and side views of an exemplary antenna, in accordance with various embodiments.

Referring to FIG. 2, a top view 202 of the antenna 100, a first side view 204 of the antenna 100, and a second side view 206 of the antenna 100 are illustrated, in accordance with various embodiments. The top view 202 of the antenna 100 illustrates at least the first patch antenna portion 102*a*, the second patch antenna portion 102*b*, the third patch antenna portion 102*c*, the fourth patch antenna portion 102*d*, the strip antenna portion 104, the first set of electrically conductive pins 110*a-d*, the aperture 112, and the second set of electrically conductive pins 114*a-q*.The first side view 204 of the antenna 100 illustrates at least the first electrically conductive surface 106, the second electrically conductive surface 108, the first electrically conductive pin 110*a*, the fourth electrically conductive pin 110*d*, the electrically conductive pin 114*a*, the electrically conductive pins 114*h-j*, and the electrically conductive pin 114*q*. The second side view 206 of the antenna 100 illustrates at least the third electrically conductive pin 110*c*, the fourth electrically conductive pin 110*d*, the electrically conductive pins 114*a-g*, the first substrate 116, and the second substrate 118.

As illustrated by FIG. 2, the antenna 100 can be an antenna system that includes the first substrate 116 and the second substrate 118. The first substrate 116 can include at least the first patch antenna portion 102*a* and the third patch antenna portion 102*c* (e.g., a first set of patch antenna sections), the second patch antenna portion 102*b* and the fourth patch antenna portion 102*d* (e.g., a second set of patch antenna sections), and the first set of electrically conductive pins 110*a-d* (e.g., a first set of metal pins). The second patch antenna portion 102*b* and the fourth patch antenna portion 102*d* (e.g., a second set of patch antenna sections) can be attached via the strip antenna portion 104. The second substrate 118 can include the second set of electrically conductive pins 114*a-q* (e.g., a second set of metal pins) that is attached to the first substrate 116 via the first electrically conductive surface 106 (e.g., a first metal surface). The second set of electrically conductive pins 114*a-q* (e.g., the second set of metal pins) can be further attached to the second electrically conductive surface 108 (e.g., a second metal surface). In an aspect, the first patch antenna portion 102*a*, the second patch antenna portion 102*b*, the third patch antenna portion 102*c* and the fourth patch antenna portion 102*d* (e.g., the first set of patch antenna portions and the second set of patch antenna sections) can be printed on top of the first substrate 116 (e.g., on a top surface of the first substrate 116).

Figure 3:
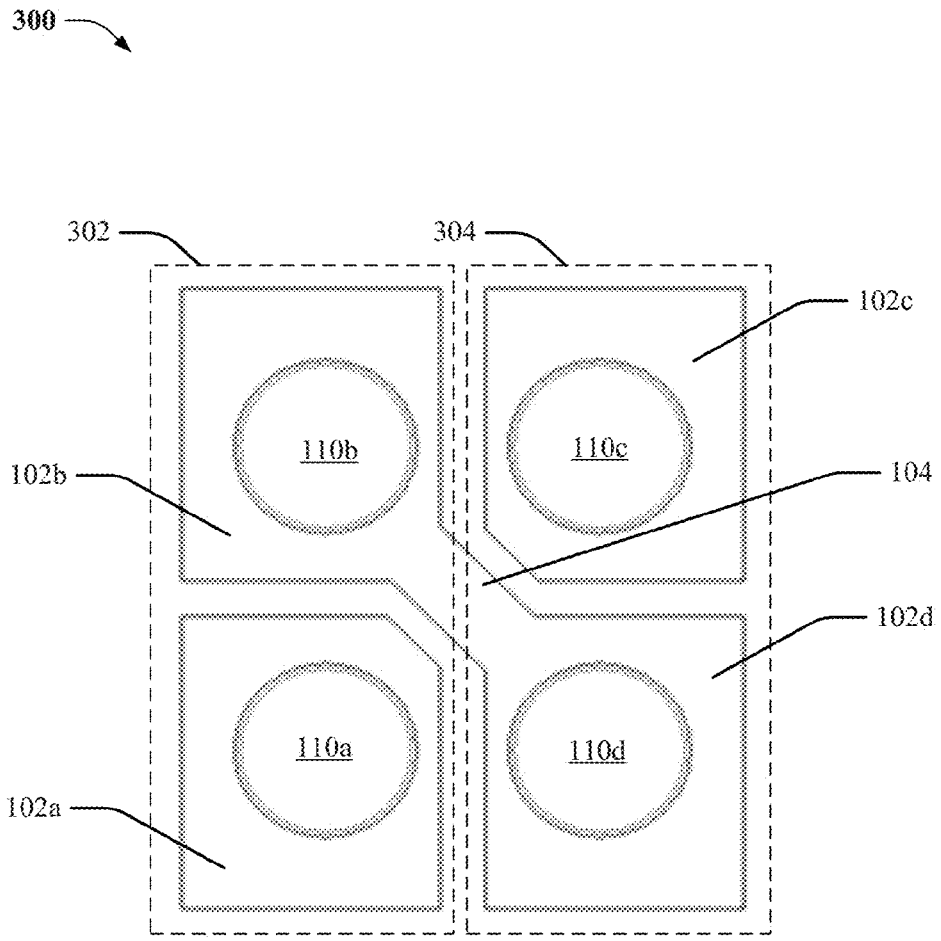
FIG. 3 illustrates an exemplary dipole portion of an antenna, in accordance with various embodiments.

Referring to FIG. 3, a dipole portion 300 of the antenna 100 is illustrated, in accordance with various embodiments. The dipole portion 300 includes a first dipole portion 302 and a second dipole portion 304. In an aspect, the first dipole portion 302 and the second dipole portion 304 can be a pair of planar dipoles (e.g., a pair of horizontal planar dipoles). The first dipole portion 302 includes the first patch antenna portion 102*a* and the second patch antenna portion 102*b*. Therefore, the first dipole portion 302 can be associated with a separation of electrical charges via the first patch antenna portion 102*a* and the second patch antenna portion 102*b*. The second dipole portion 304 includes the third patch antenna portion 102*c* and the fourth patch antenna portion 102*d*. Therefore, the second dipole portion 304 can be associated with a separation of electrical charges via the third patch antenna portion 102*c* and the fourth patch antenna portion 102*d*. The fourth patch antenna portion 102*d* can be electrically coupled to the second patch antenna portion 102*b* via the strip antenna portion 104.

The patch antenna portions 102*a-d* can be implemented as metallic patch sections. In one example, the first patch antenna portion 102*a* and the third patch antenna portion 102*c* can be associated with a first electrical charge, and the second patch antenna portion 102*b* and the fourth patch antenna portion 102*d* can be associated with a second electrical charge. In another example, the first patch antenna portion 102*a* can be associated with a first electrical charge, the third patch antenna portion 102*c* can be associated with a second electrical charge, and the second patch antenna portion 102*b* and the fourth patch antenna portion 102*d* can be associated with a third electrical charge. As illustrated by FIG. 3, the first electrically conductive pin 110*a* can be associated with the first patch antenna portion 102*a*, the second electrically conductive pin 110*b* can be associated with the second patch antenna portion 102*b*, the third electrically conductive pin 110*c* can be associated with the third patch antenna portion 102*c*, and the fourth electrically conductive pin 110*d* can be associated with the fourth patch antenna portion 102*d*. The electrically conductive pins 110*a-d* can be implemented as metallic pins. In an aspect, the configuration of the dipole portion 300 (e.g., the patch antenna portions 102*a-d*) and the electrically conductive pins 110*a-d* can provide circularly polarized radiation. For example, an inner corner of the first patch antenna portion 102*a* and an inner corner of the third patch antenna portion

102*c* can be partially removed (e.g., partially cut), while an inner corner of the second patch antenna portion 102*b* and an inner corner of the fourth patch antenna portion 102*d* can be attached by the strip antenna portion 104 (e.g., a narrow rectangular strip).

Figure 4:
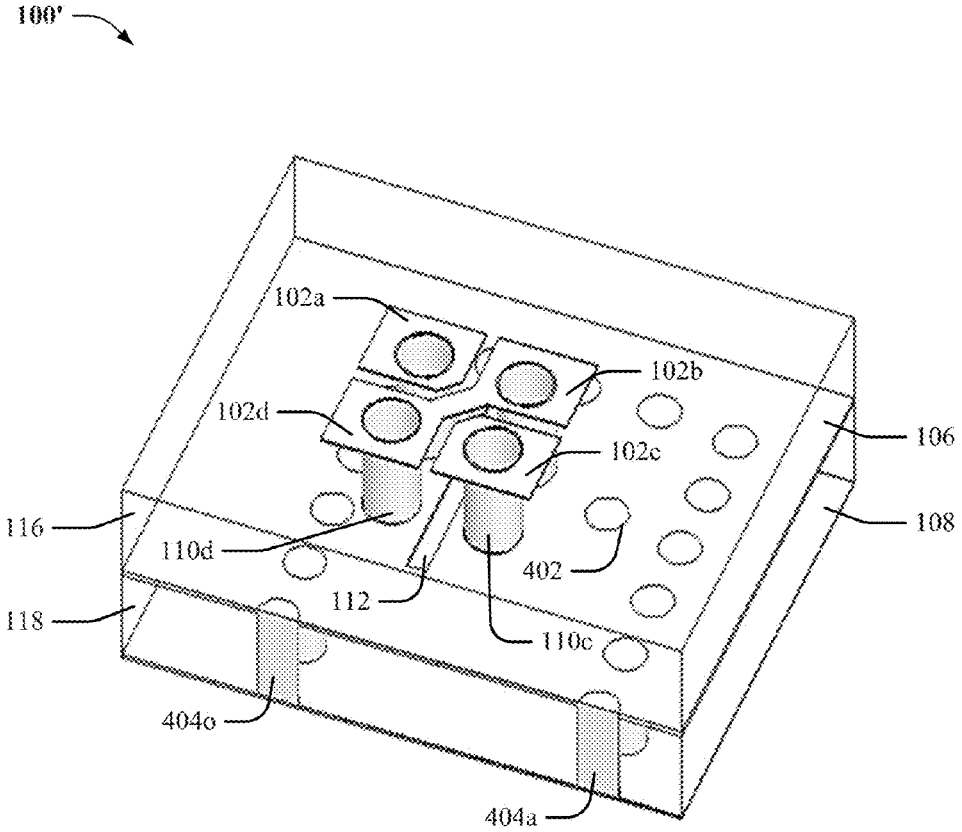
FIG. 4 illustrates a perspective view of another exemplary antenna, in accordance with various embodiments.

Referring now to FIG. 4, a perspective view of an antenna 100' is illustrated, in accordance with various embodiments. The antenna 100' can be an alternate embodiment of the antenna 100. The antenna 100' includes the first patch antenna portion 102*a*, the second patch antenna portion 102*b*, the third patch antenna portion 102*c*, the fourth patch antenna portion 102*d*, the strip antenna portion 104, the first electrically conductive surface 106, the second electrically conductive surface 108, the first set of electrically conductive pins 110*a-d*, the aperture 112, the first substrate 116, and the second substrate 118. The antenna 100' also includes an electrically conductive pin 402 and a second set of electrically conductive pins 404*a-o*. The electrically conductive pin 402 can match an impedance associated with the first dipole portion 302 (e.g., the first patch antenna portion 102*a* and the second patch antenna portion 102*b*) and the second dipole portion 304 (e.g., the third patch antenna portion 102*c* and the fourth patch antenna portion 102*d*). Furthermore, the second electrically conductive surface 108 can be additionally coupled to the first electrically conductive surface 106 via the electrically conductive pin 402. The second set of electrically conductive pins 404*a-o* can be an alternate embodiment of the second set of electrically conductive pins 114*a-q*. For example, the second set of electrically conductive pins 404*a-o* can include less electrically conductive pins than the second set of electrically conductive pins 114*a-q*. Additionally or alternatively, an arrangement of the second set of electrically conductive pins 404*a-o* with respect to the dipole portion 300 (e.g., the patch antenna portions 102*a-d*) can be different than an arrangement of the second set of electrically conductive pins 114*a-q* with respect to the dipole portion 300 (e.g., the patch antenna portions 102*a-d*). For example, an opening for a U-shaped arrangement of the second set of electrically conductive pins 404*a-o* can be associated with the third patch antenna portion 102*c* and the fourth patch antenna portion 102*d*.

Figure 5:
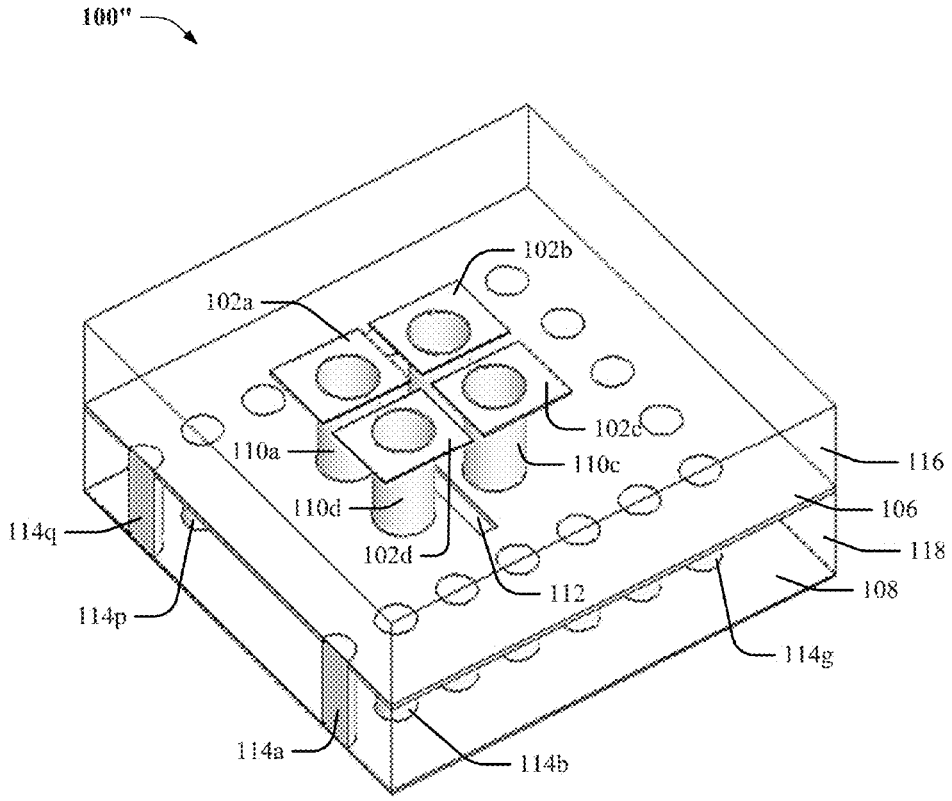
FIG. 5 illustrates a perspective view of yet another exemplary antenna, in accordance with various embodiments.

Referring now to FIG. 5, a perspective view of an antenna 100" is illustrated, in accordance with various embodiments. The antenna 100" can be an alternate embodiment of the antenna 100. The antenna 100" includes the first patch antenna portion 102*a*, the second patch antenna portion 102*b*, the third patch antenna portion 102*c*, the fourth patch antenna portion 102*d*, the first electrically conductive surface 106, the second electrically conductive surface 108, the first set of electrically conductive pins 110*a-d*, the second set of electrically conductive pins 112*a-q*, the aperture 112, the first substrate 116, and the second substrate 118. However, the antenna 100" can be implemented without the strip antenna portion 104. Furthermore, the first patch antenna portion 102*a*, the second patch antenna portion 102*b*, the third patch antenna portion 102*c*, the fourth patch antenna portion 102*d* can each include a corresponding (e.g., the same) surface area. It is to be appreciated that electrical charge of the patch antenna portions 102*a-d* can be varied. For example one or more of the patch antenna portions 102*a-d* can be associated with a corresponding electrical charge and/or a different electrical charge. In an aspect, configuration of the patch antenna portions 102*a-d* associated with the antenna 100" can be employed for linearly polarized radiation.

Figure 6:
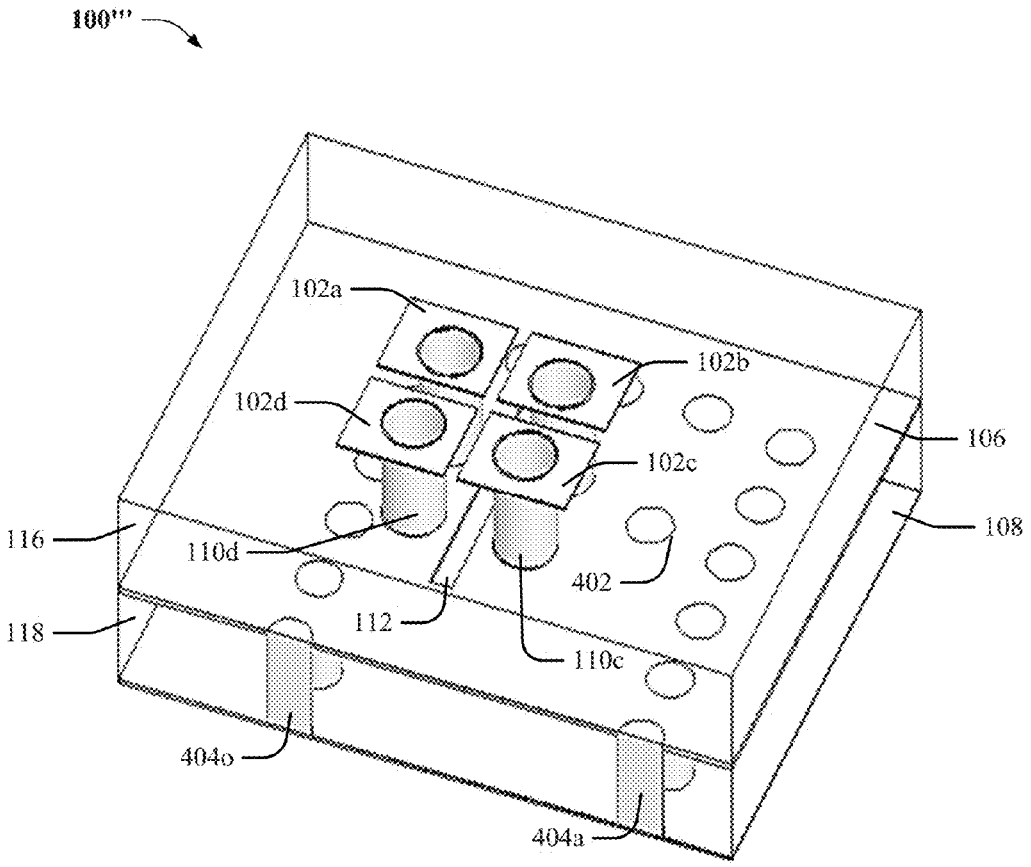
FIG. 6 illustrates a perspective view of yet another exemplary antenna, in accordance with various embodiments.

Referring now to FIG. 6, a perspective view of an antenna 100'" is illustrated, in accordance with various embodiments. The antenna 100'" can be an alternate embodiment of the antenna 100'. The antenna 100'" includes the first patch antenna portion 102*a*, the second patch antenna portion 102*b*, the third patch antenna portion 102*c*, the fourth patch antenna portion 102*d*, the first electrically conductive surface 106, the second electrically conductive surface 108, the first set of electrically conductive pins 110*a-d*, the aperture 112, the first substrate 116, the second substrate 118, the electrically conductive pin 402, and the second set of electrically conductive pins 404*a-o*. However, the antenna 100'" can be implemented without the strip antenna portion 104. Furthermore, the first patch antenna portion 102*a*, the second patch antenna portion 102*b*, the third patch antenna portion 102*c*, the fourth patch antenna portion 102*d* can each include a corresponding (e.g., the same) surface area. In an aspect, configuration of the patch antenna portions 102*a-d* associated with the antenna 100'" can be employed for linearly polarized radiation.

Figure 7:
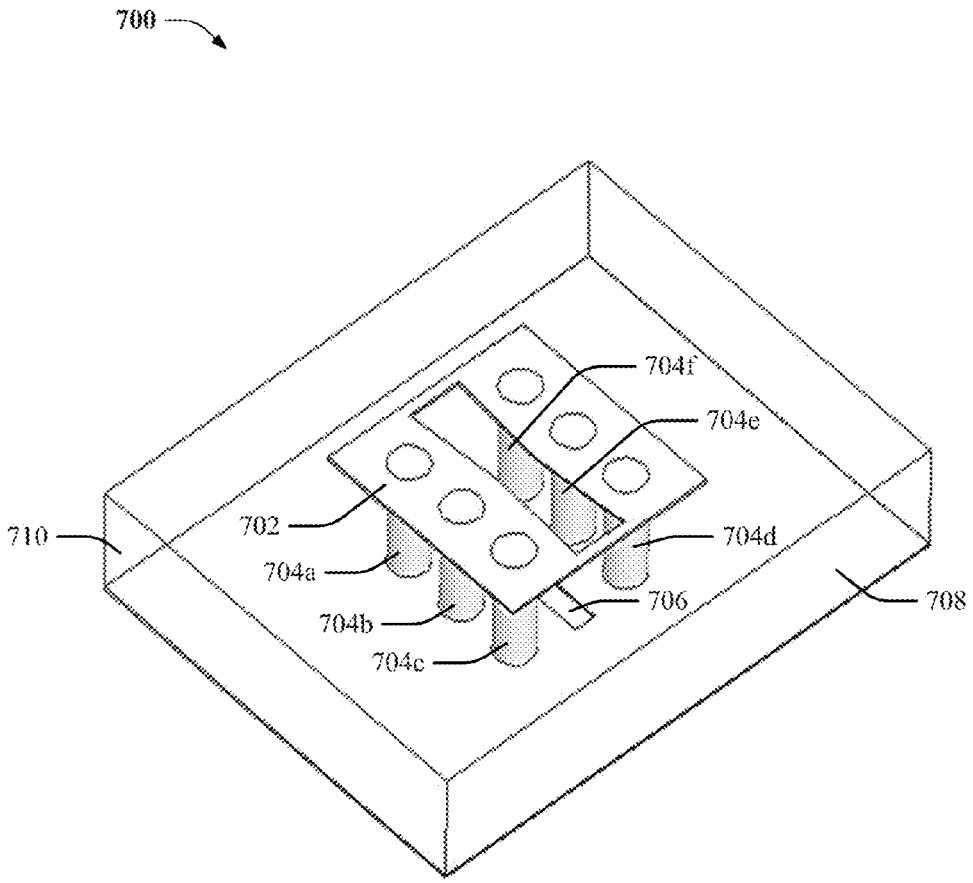
FIG. 7 illustrates a perspective view of yet another exemplary antenna, in accordance with various embodiments.

Referring to FIG. 7, a perspective view of an antenna 700 is illustrated, in accordance with various embodiments. In one example, the antenna 700 can a wideband complementary antenna. In another example, the antenna 700 can be a linearly polarized complementary antenna. The antenna 700 includes a patch antenna portion 702, a first set of electrically conductive pins 704*a-f*, an aperture 706, a first electrically conductive surface 708 and a first substrate 710. In one example, the first electrically conductive surface 708 can be implemented as a metallic clad surface (e.g., a copper clad surface, etc.). The first electrically conductive surface 708 can be coupled to the patch antenna portion 702 via the first set of electrically conductive pins 704*a-f*. The aperture 706 can be etched on the first electrically conductive surface 708. In an aspect, a first electrically conductive pin 704*a*, a second electrically conductive pin 704*b*, and a third electrically conductive pin 704*c* can be separated from a fourth electrically conductive pin 704*d*, a fifth electrically conductive pin 704*e*, and a sixth electrically conductive pin 704*f* via the aperture 706 etched on the first electrically conductive surface 708. In an implementation, the first electrically conductive surface 708 can be coupled to a second electrically conductive surface (e.g., second electrically conductive surface 108, etc.) via a second set of electrically conductive pins (e.g., second set of electrically conductive pins 114*a-q*, etc.). The first substrate 710 can include the patch antenna portion 702 and the first set of electrically conductive pins 704*a-f*. The first substrate 710 can be a single-layered substrate. In another implementation, the first electrically conductive surface 708 can separate the first substrate 710 from a second substrate (e.g., second substrate 118 that includes the second set of electrically conductive pins 114*a-q*, etc.). In yet another implementation, the patch antenna portion 702 can be electrically excited via a second electrically conductive surface (e.g., the second electrically conductive surface 108, etc.) that is coupled to the first electrically conductive surface 707 via a second set of electrically conductive pins (e.g., the second set of electrically conductive pins 114*a-q*, etc.).

Figure 8:
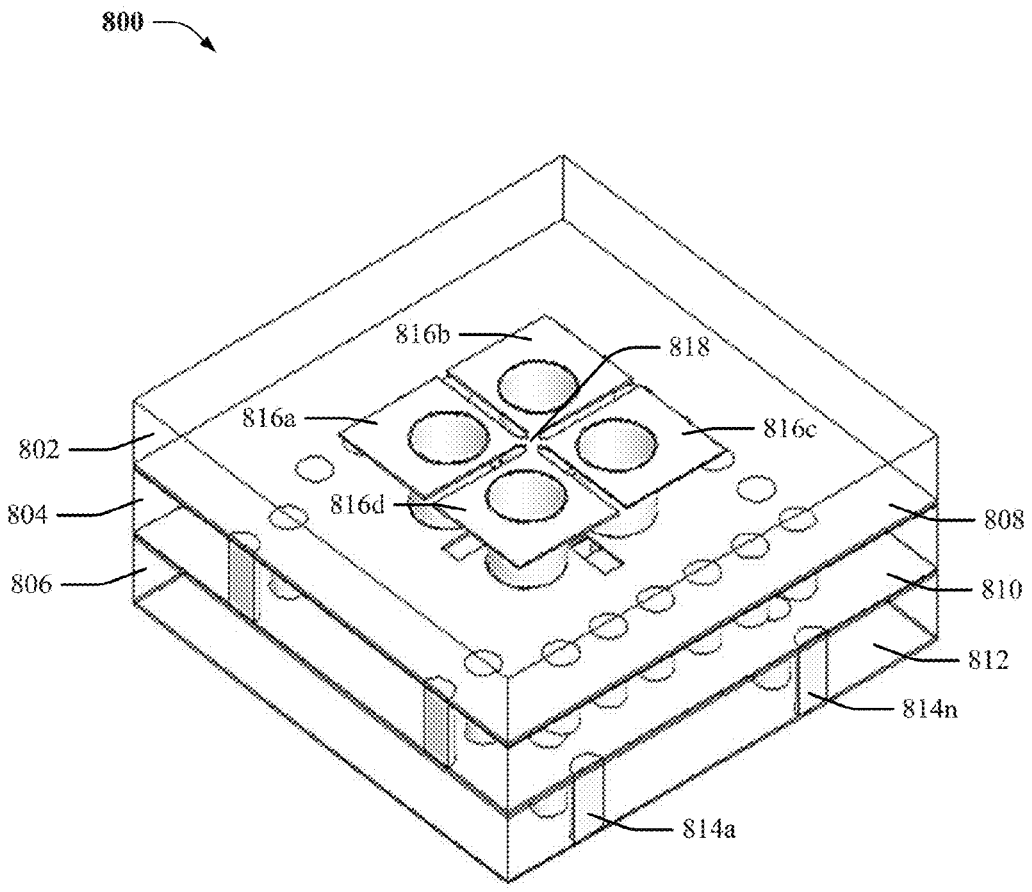
FIG. 8 illustrates a perspective view of yet another exemplary antenna, in accordance with various embodiments.

Referring to FIG. 8, a perspective view of an antenna 800 is illustrated, in accordance with various embodiments. The antenna 800 can be, for example, a wideband complementary antenna. The antenna 800 includes a first substrate 802, a second substrate 804, and a third substrate 806. In an implementation, the first substrate 802 can correspond to the first substrate 116 or the first substrate 710. Additionally or alternatively, the second substrate 804 can correspond to the second substrate 118. The antenna 800 also includes a first electrically conductive surface 808, a second electrically conductive surface 810, and a third electrically conductive surface 812. In an implementation, the first electrically conductive surface 808 can correspond to the first electrically conductive surface 106 or the first electrically conductive surface 708. Additionally or alternatively, the second electrically conductive surface 810 can correspond to the second electrically conductive surface 108. The third electrically conductive surface 812 can be coupled to the second electrically conductive surface 810 via a third set of electrically conductive pins 814*a-n*. In certain implementations, the third electrically conductive surface 812 can implemented in the antenna 100, the antenna 100', the antenna 100" or the antenna 100'" (e.g., by being coupled to the second electrically conductive surface 108 via the third set of electrically conductive pins 814*a-n*). In an aspect, patch antenna portions (e.g., the patch antenna portions 102*a-d*, etc.) can be electrically excited via the third electrically conductive surface 812. The antenna 800 can be employed for dual polarized radiation. For example, the antenna 800 can include patch antenna portions 816*a-d*. The patch antenna portions 816*a-d* can be identical planar patch sections. Furthermore, a crossed strip antenna portion 818 can be coupled to each of the patch antenna portions 816*a-d* (e.g., the crossed strip antenna portion 818 can connect the patch antenna portions 816*a-d* together). The patch antenna portions 816*a-d* can be excited by two stacked SIWs (e.g., a first SIW integrated in the second substrate 804 and a second SIW integrated in the third substrate 806).

Figure 9:
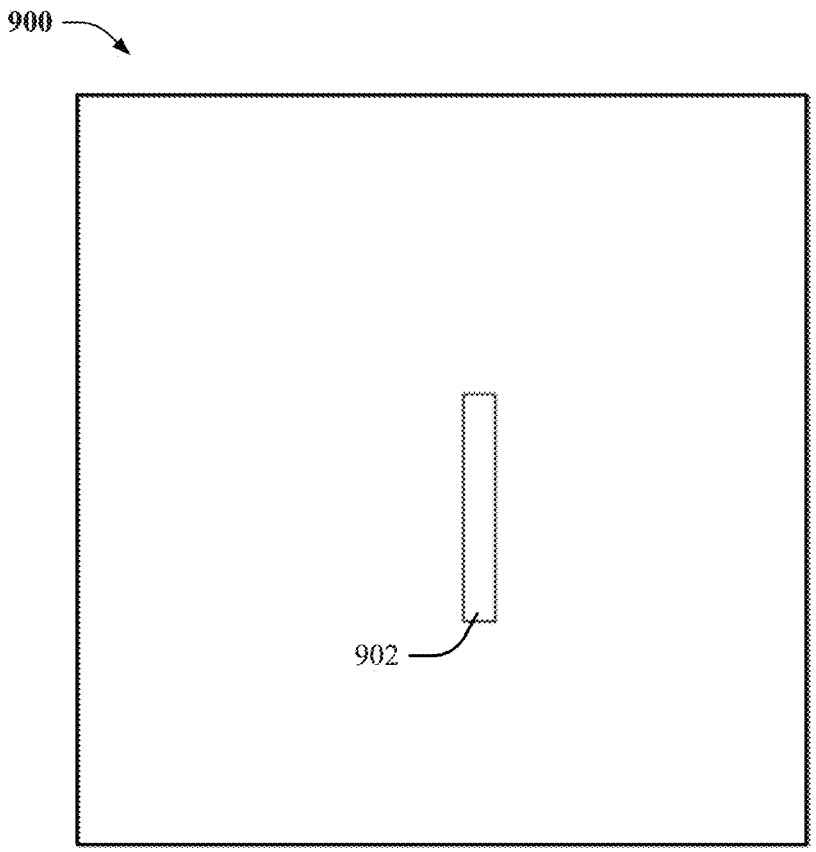
FIG. 9 illustrates a top view of an exemplary electrically conductive surface of an antenna, in accordance with various embodiments.

Referring to FIG. 9, a top view of an electrically conductive surface 900 is illustrated, in accordance with various embodiments. The electrically conductive surface 900 includes an aperture 902. The aperture 902 can, for example, correspond to the aperture 112 or the aperture 706. The electrically conductive surface 900 can correspond to a first electrically conductive surface (e.g., first electrically conductive surface 106, first electrically conductive surface 708, first electrically conductive surface 808, etc.) or a second electrically conductive surface (e.g., second electrically conductive surface 108, second electrically conductive surface 810, etc.). In an aspect, the first aperture 902 can be associated with a dipole portion and/or a set of electrically conductive pins of an antenna. For example, the electrically conductive surface 900 can be coupled to a dipole portion (e.g., dipole portion 300, etc.) and/or a set of electrically conductive pins (e.g., the first set of electrically conductive pins 110*a-d*, the second set of electrically conductive pins 114*a-q*, etc.). In another aspect, a signal (e.g., an input signal) can be coupled from an SIW structure (e.g., the set of electrically conductive pins 114*a-q* integrated in the second substrate 118) to the first set of electrically conductive pins 110*a-d* and/or the patch antenna portions 102*a-d* via the first aperture 902.

Figure 10:
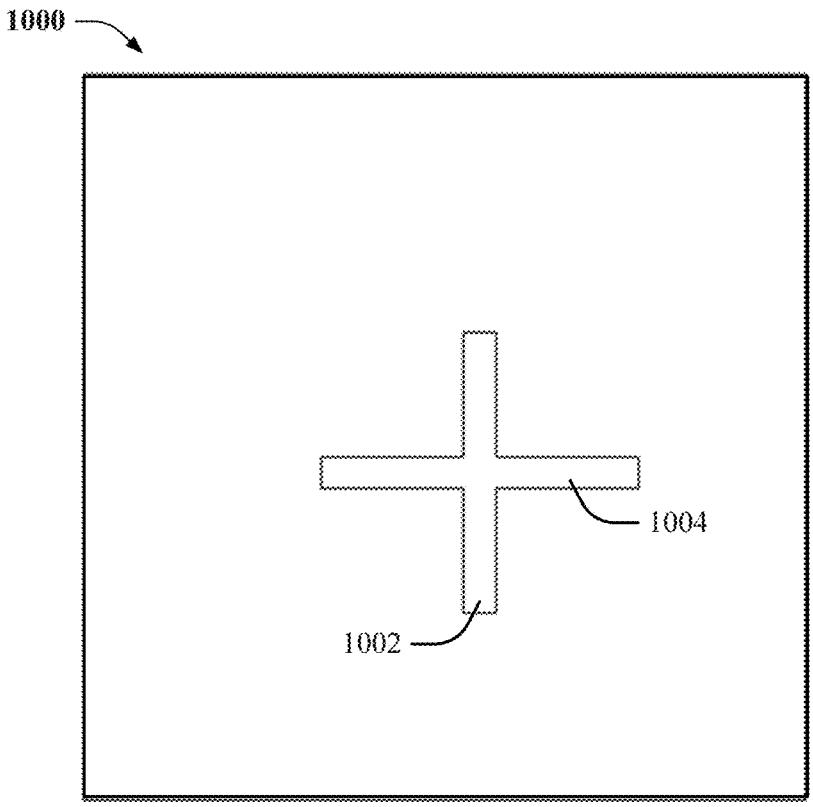
FIG. 10 illustrates a top view of another exemplary electrically conductive surface of an antenna, in accordance with various embodiments.

Referring to FIG. 10, a top view of an electrically conductive surface 1000 is illustrated, in accordance with various embodiments. The electrically conductive surface 1000 includes a first aperture 1002 and a second aperture 1004. The first aperture 1002 and the second aperture 1004 can, for example, correspond to an alternate embodiment of the aperture 112 or the aperture 706. The first aperture 1002 and the second aperture 1004 can be arranged is a cross-shaped pattern. The electrically conductive surface 1000 can correspond to a first electrically conductive surface (e.g., first electrically conductive surface 106, first electrically conductive surface 708, first electrically conductive surface 808, etc.) or a second electrically conductive surface (e.g., second electrically conductive surface 108, second electrically conductive surface 810, etc.). In an aspect, the first aperture 1002 and the second aperture 1004 can be associated with a dipole portion and/or a set of electrically conductive pins of an antenna. For example, the electrically conductive surface 1000 can be coupled to a dipole portion (e.g., dipole portion 300, etc.) and/or a set of electrically conductive pins (e.g., set of electrically conductive pins 110*a-d*, set of electrically conductive pins 114*a-q*, etc.). In an aspect, a signal (e.g., an input signal) can be coupled from an SIW structure (e.g., the set of electrically conductive pins 114*a-q* integrated in the second substrate 118) to the first set of electrically conductive pins 110*a-d* and/or the patch antenna portions 102*a-d* via the first aperture 1002 and the second aperture 1004.

Figure 11:
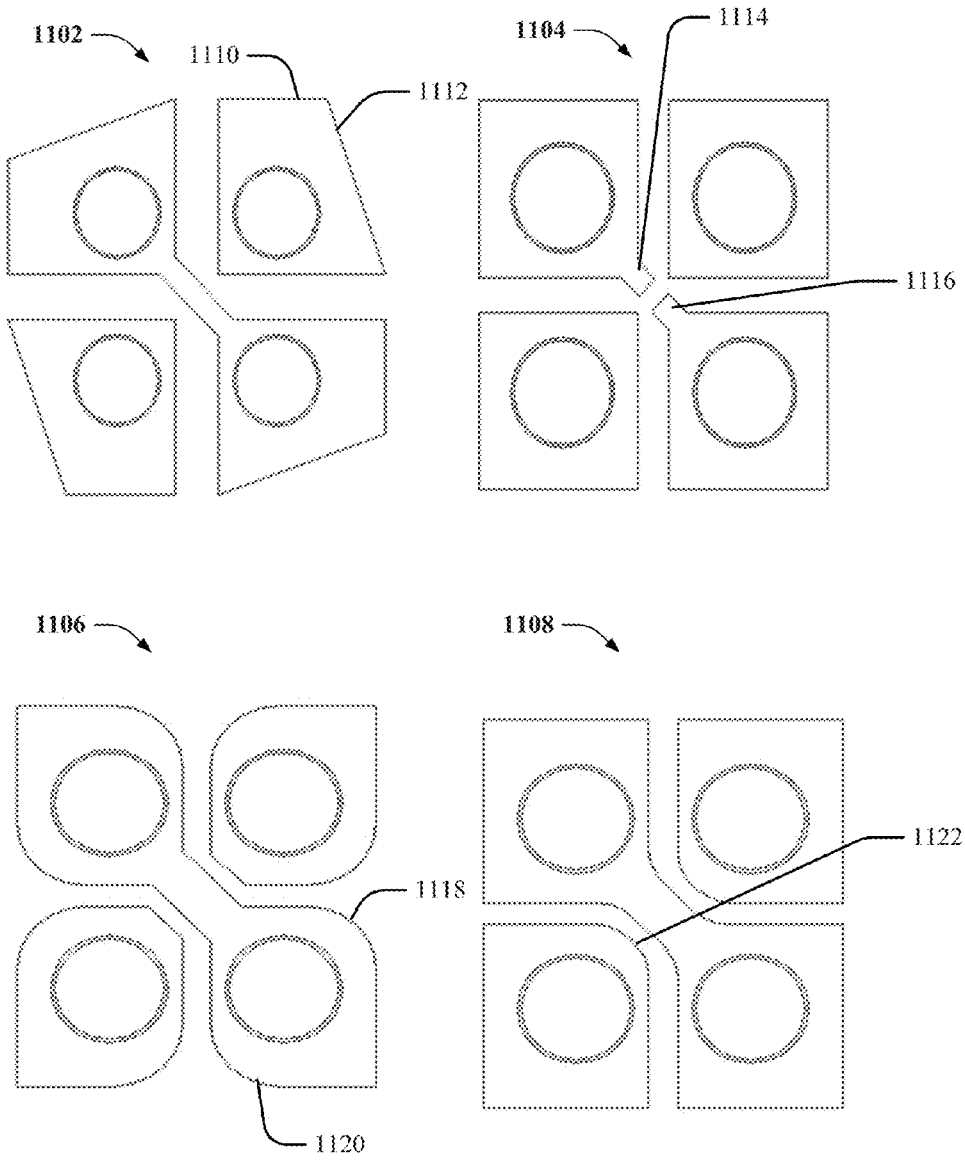
FIGS. 11-12 illustrate various shapes for a dipole portion associated with an antenna, in accordance with various embodiments.

FIG. 11 illustrates various shapes for a dipole portion associated with an antenna, in accordance with various embodiments. For example, FIG. 11 illustrates a dipole portion 1102, a dipole portion 1104, a dipole portion 1106, and a dipole portion 1108. The dipole portion 1102, the dipole portion 1104, the dipole portion 1106, and the dipole portion 1108 can be alternative embodiments for the dipole portion 300. A patch antenna portion included in the dipole portion 1102 can include, for example, at least a first side 1110 that is a different length than a second side 1112. A patch antenna portion included in the dipole portion 1104 can include, for example, at least a first strip antenna portion 1114 that is not attached to another strip antenna portion 1116 associated with another patch antenna portion included in the dipole portion 1104. A patch antenna portion included in the dipole portion 1106 can include, for example, at least an outer first curved side 1118 and a outer second curved side 1120 (e.g., that form a teardrop-shaped patch antenna portion). A patch antenna portion included in the dipole portion 1108 can include, for example, at least at an inner curved side 1122.

Figure 12:
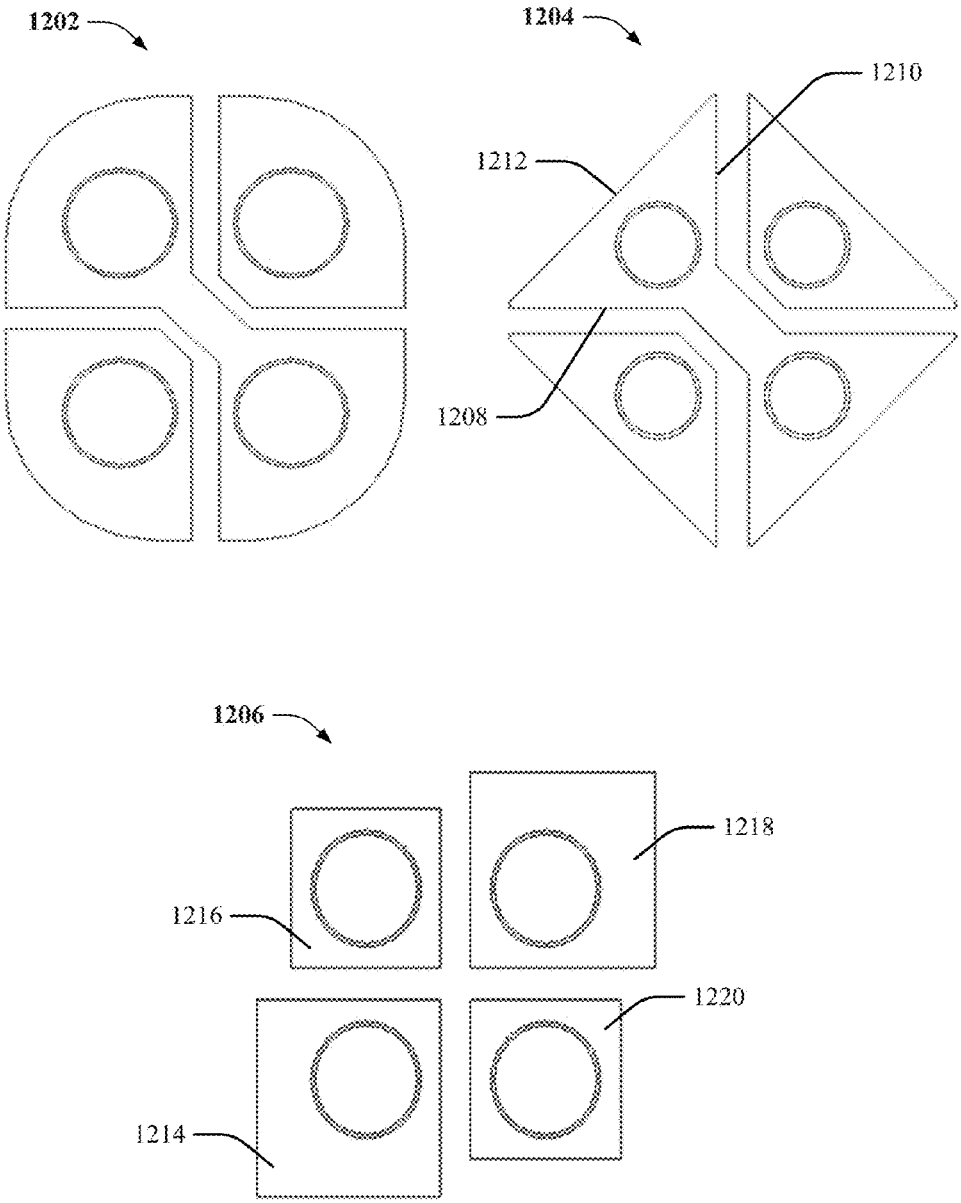

FIG. 12 also illustrates various shapes for a dipole portion associated with an antenna, in accordance with various embodiments. For example, FIG. 12 illustrates a dipole portion 1202, a dipole portion 1204, and a dipole portion 1206. The dipole portion 1202, the dipole portion 1204, and the dipole portion 1206 can also be alternative embodiments for the dipole portion 300. An outer perimeter of the dipole portion 1202 can correspond to a circular shape rather than a square shape. A patch antenna portion included in the dipole portion 1204 can include, for example, at least a first side 1208 and a second side 1210 with a corresponding length, and a third side 1212 that is a different length than the corresponding length of the first side 1208 and the second side 1210. A shape of a patch antenna portion 1214 included in the dipole portion 1206 can correspond to a shape of a patch antenna portion 1216, a patch antenna portion 1218 and a patch antenna portion 1220. However, a size of the shape of the patch antenna portion 1214 can be larger than a size of the shape of the patch antenna portion 1216 and the patch antenna portion 1220, while being the same as a size of the shape of the patch antenna portion 1218.

Figure 13:
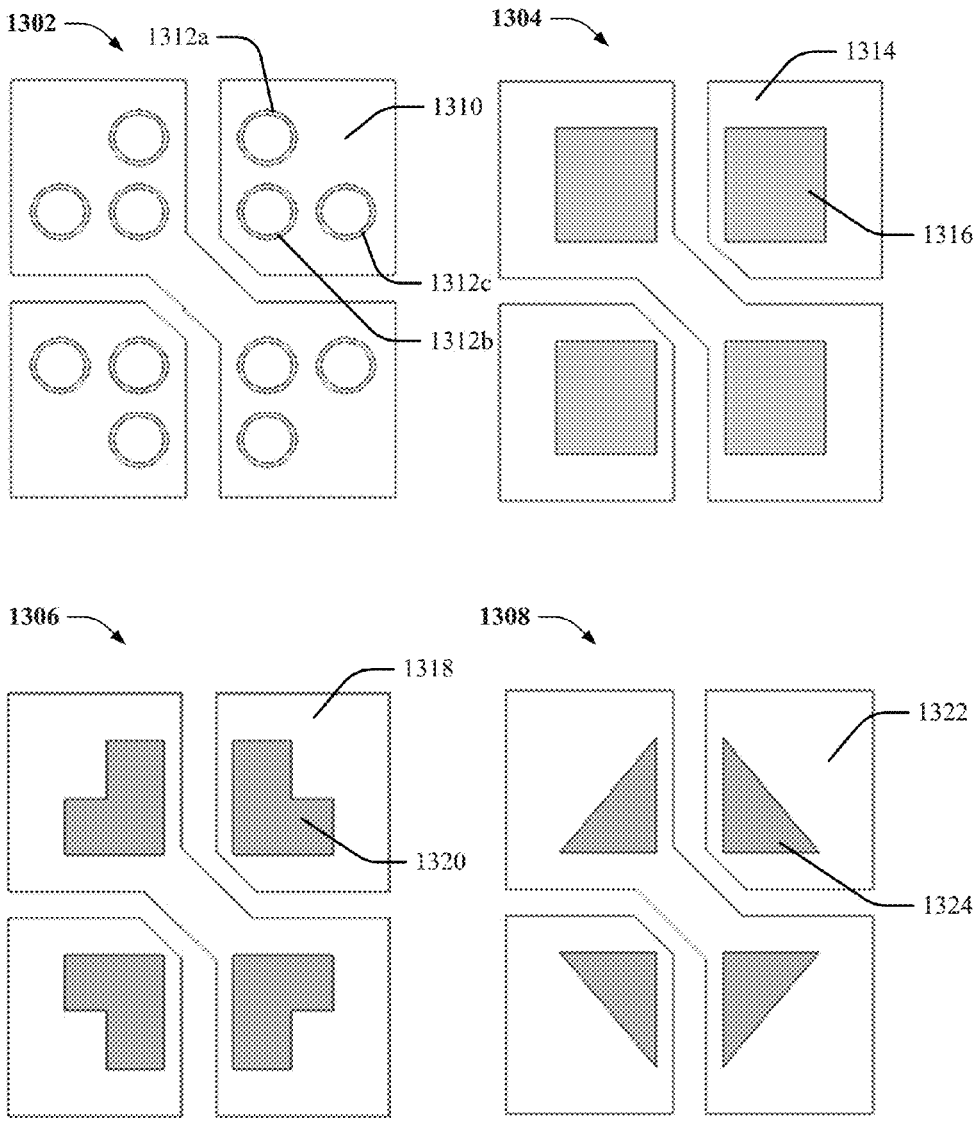
FIGS. 13 illustrates various shapes for electrically conductive pins associated with a dipole portion of an antenna, in accordance with various embodiments.

FIG. 13 illustrates various shapes for electrically conductive pins associated with a dipole portion of an antenna, in accordance with various embodiments. For example, FIG. 13 illustrates a dipole portion 1302, a dipole portion 1304, a dipole portion 1306, and a dipole portion 1308. Each patch antenna portion included in the dipole portion 1302 can be associated with a set of electrically conductive pins. For example, a patch antenna portion 1310 included in the dipole portion 1302 can be associated with a set of electrically conductive pins 1312*a-c*. Each patch antenna portion included in the dipole portion 1304 can be associated with an electrically conductive via (e.g., an electrical connection)

shaped as a square. For example, a patch antenna portion 1314 included in the dipole portion 1304 can be associated with a square-shaped via 1316. Each patch antenna portion included in the dipole portion 1306 can be associated with an electrically conductive via that is L-shaped. For example, a patch antenna portion 1318 included in the dipole portion 1306 can be associated with an L-shaped via 1320. Each patch antenna portion included in the dipole portion 1308 can be associated with an electrically conductive via shaped as a triangle. For example, a patch antenna portion 1322 included in the dipole portion 1308 can be associated with a triangle-shaped via 1324.

Figure 14:
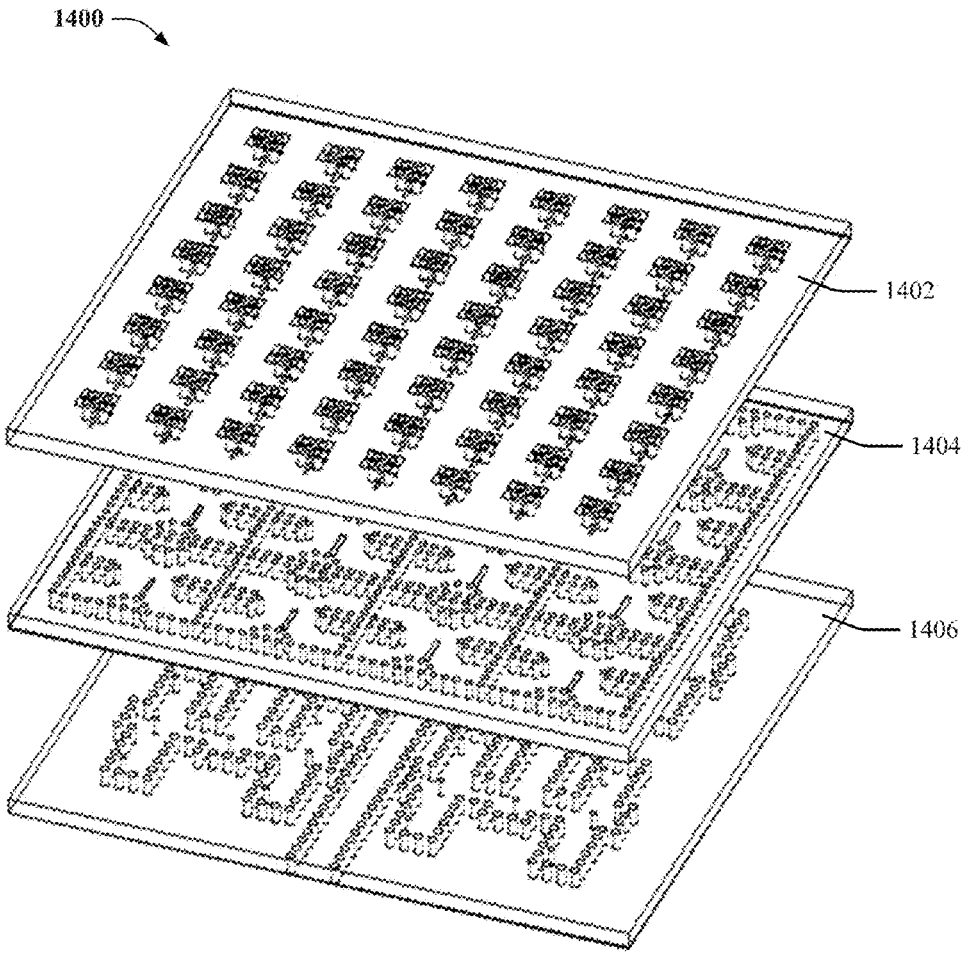
FIG. 14 illustrates a perspective view of yet another exemplary antenna, in accordance with various embodiments.

Referring now to FIG. 14, a perspective view of an antenna 1400 is illustrated, in accordance with various embodiments. The antenna 1400 includes a first substrate 1402, a second substrate 1404, and a third substrate 1406. In one example, the antenna 1400 can be an 8×8 complementary antenna array. In another example, the antenna 1400 can be a complementary antenna array fed by a parallel SIW feed network. The parallel SIW feed network can be fabricated in the second substrate 1404 and the third substrate 1406. For example, a first portion of the feed network can be integrated into the third substrate 1406, while the a second portion of the feed network (e.g. a second portion of the feed network for all 2×2 sub-arrays) can integrated into the second substrate 1404. In an aspect, the first substrate can comprises a plurality of dipole portions and/or a plurality of sets of electrically conductive pins.

Figure 15:
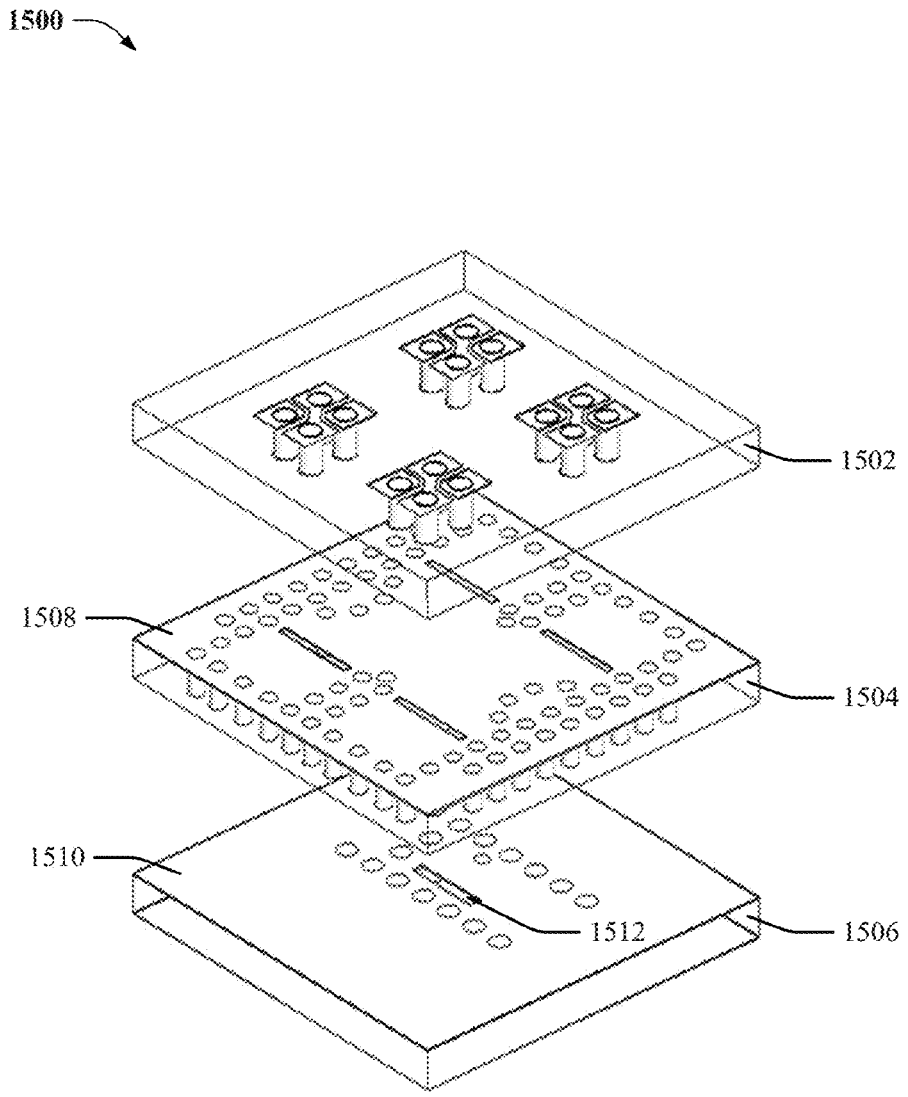
FIG. 15 illustrates a perspective view of yet another exemplary antenna, in accordance with various embodiments.

Referring now to FIG. 15, a perspective view of an antenna 1500 is illustrated, in accordance with various embodiments. The antenna 1500 includes a first substrate 1502, a second substrate 1504, and a third substrate 1506. The antenna 1500 also includes a first electrically conductive surface 1508 and a second electrically conductive surface 1510. The first substrate 1502 can be associated with a 2×2 sub-array. The 2×2 sub-array associated with the first substrate 1502 can be fed by a 2×2 feed network associated with the second substrate 1504 and/or a 2×2 feed network associated with the third substrate 1506. An aperture 1512 can be etched on the second electrically conductive surface 1510. The aperture 1512 can be employed to couple a signal (e.g., an input signal) from a portion of a feed network (e.g., a feed network associated with the second substrate 1504 and/or the third substrate 1506) to the 2×2 sub-array associated with the first substrate 1502. In an aspect, the first electrically conductive surface 1508 can be a top metallic clad surface (e.g., a top copper clad surface, etc.) of the first substrate 1502 and/or the second electrically conductive surface 1510 can be a top metallic clad surface (e.g., a top copper clad surface, etc.) of the third substrate 1506.

Figure 16:
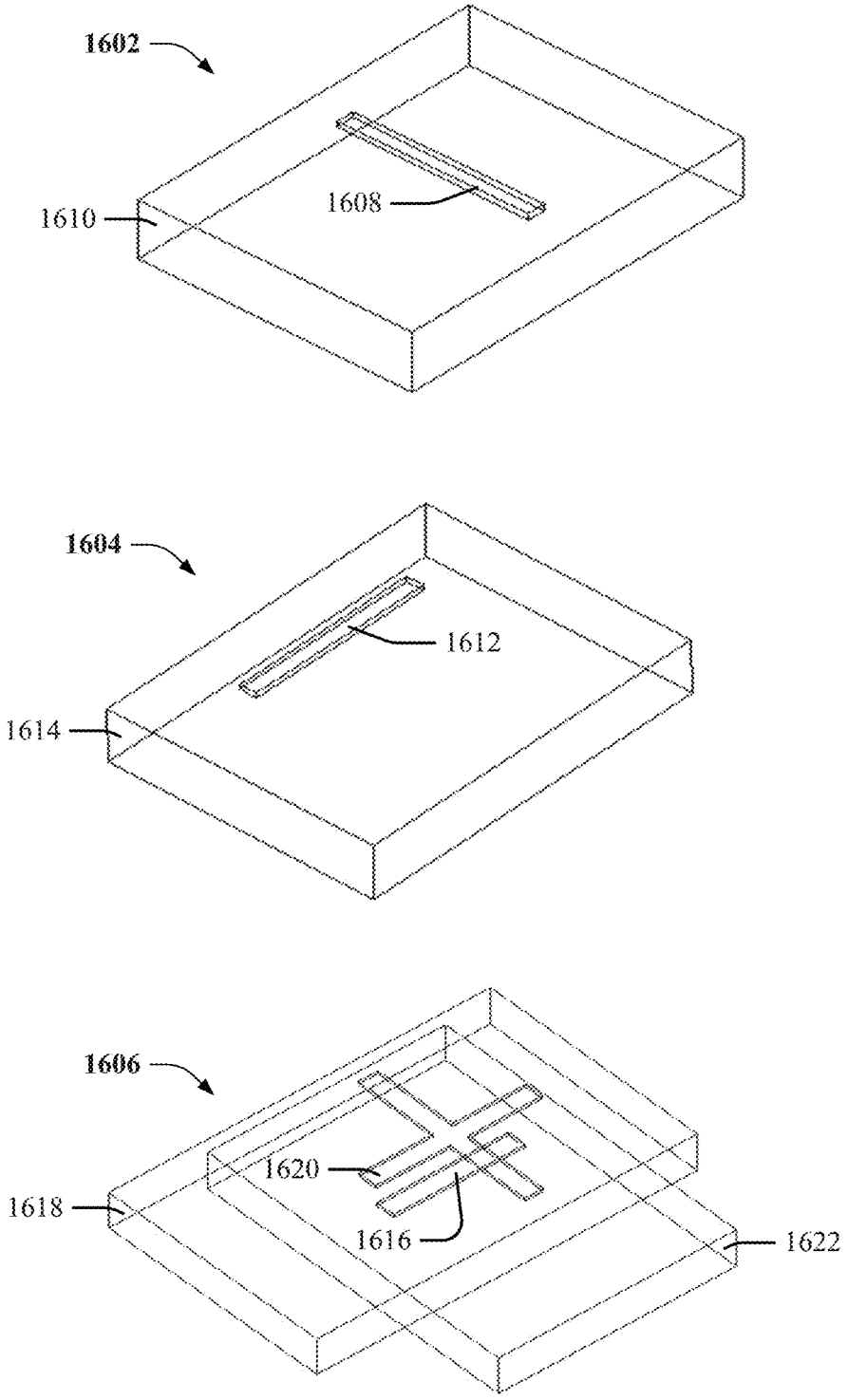
FIG. 16 illustrates a perspective view of various waveguide feeds for an antenna, in accordance with various embodiments.

Referring to FIG. 16, a perspective view of various waveguide feeds for an antenna is illustrated, in accordance with various embodiments. For example, FIG. 16 illustrates a waveguide feed 1602, a waveguide feed 1604, and a waveguide feed 1606. The waveguide feed 1602 can include a shorted-end waveguide 1608 integrated in a substrate 1610. In one example, the shorted-end waveguide 1608 can be a substrate integrated waveguide. In another example, an electrically conductive surface (e.g., second electrically conductive surface 108, second electrically conductive surface 810, etc.) can comprise the shorted-end waveguide 1608. The waveguide feed 1604 can also include a shorted-end waveguide 1612 integrated in a substrate 1614. In one example, the shorted-end waveguide 1612 can be a substrate integrated waveguide. In another example, an electrically conductive surface (e.g., second electrically conductive surface 108, second electrically conductive surface 810, etc.) can comprise the shorted-end waveguide 1612. The waveguide feed 1606 can include a shorted-end waveguide 1616 integrated in a first substrate 1618 and a waveguide 1620 integrated in a second substrate 1622. The shorted-end waveguide 1616 and the waveguide 1620 can be implemented together as two stacked waveguides. In one example, the shorted-end waveguide 1616 and/or the waveguide 620 can be a substrate integrated waveguide. In another example, an electrically conductive surface (e.g., second electrically conductive surface 108, second electrically conductive surface 810, etc.) can comprise the shorted-end waveguide 1616 and/or the waveguide 620.

Figure 17:
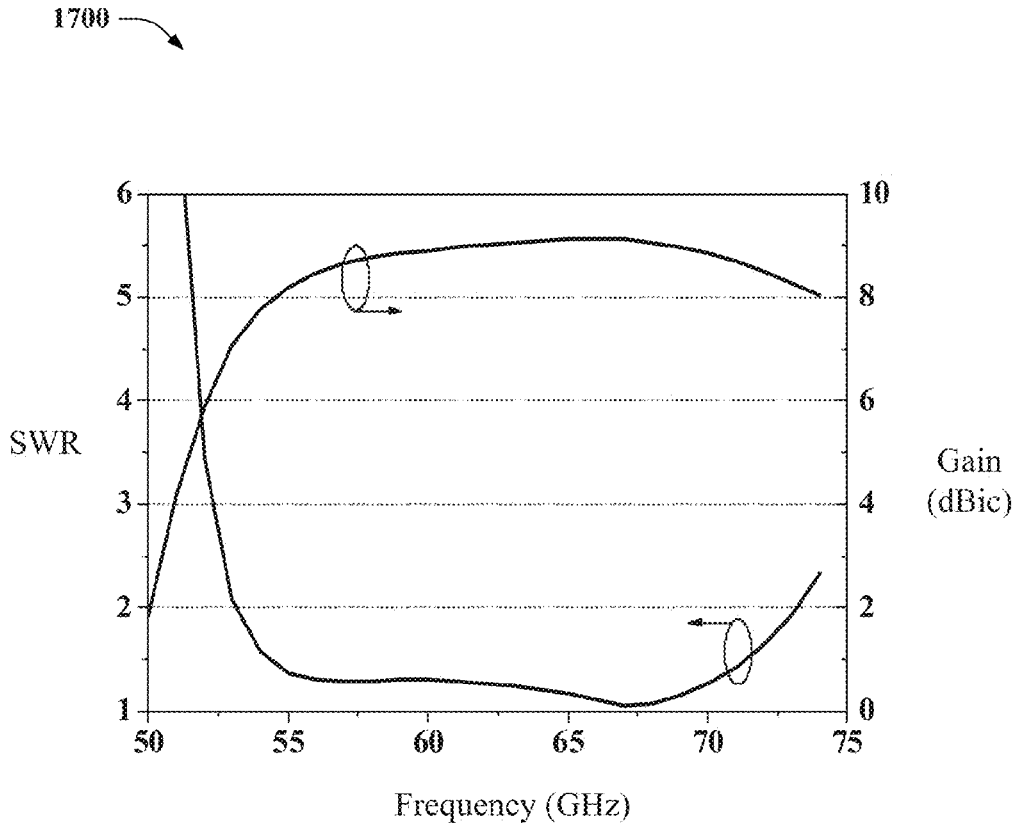
FIG. 17 illustrates simulated standing wave ratio and gain of an antenna, in accordance with various embodiments.
Figure 18:
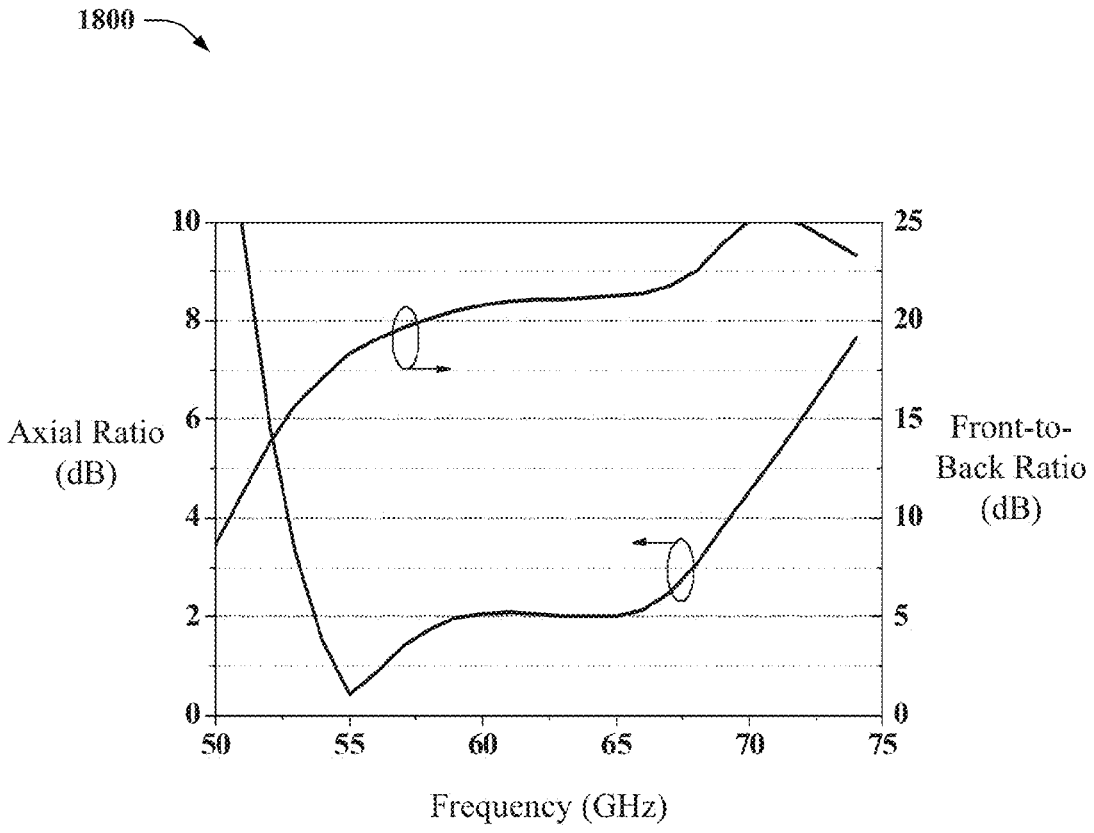
FIG. 18 illustrates simulated axial ratio and front to back ratio of an antenna, in accordance with various embodiments.
Figure 19:
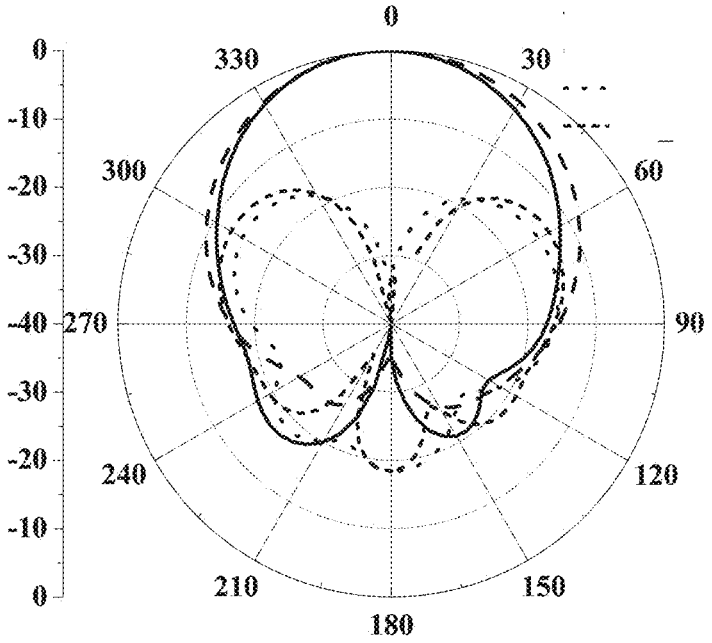
FIGS. 19-21 illustrate simulated radiation patterns for an antenna, in accordance with various embodiments.
Figure 20:
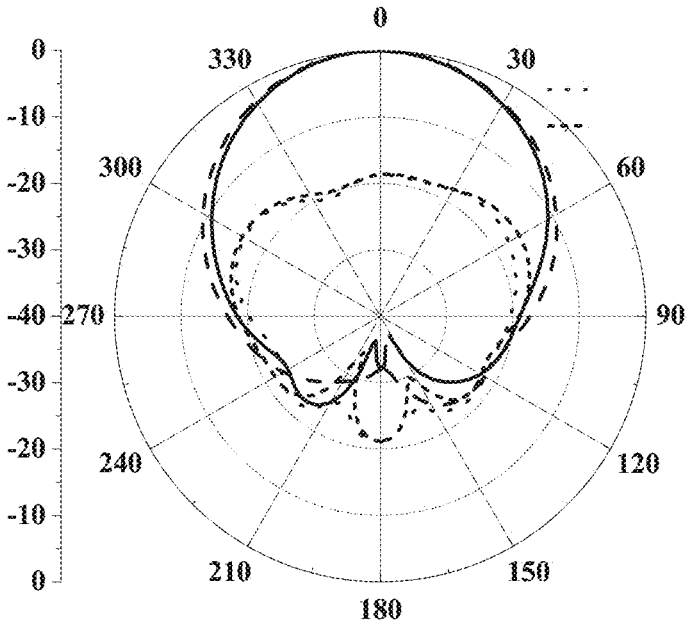
Figure 21:
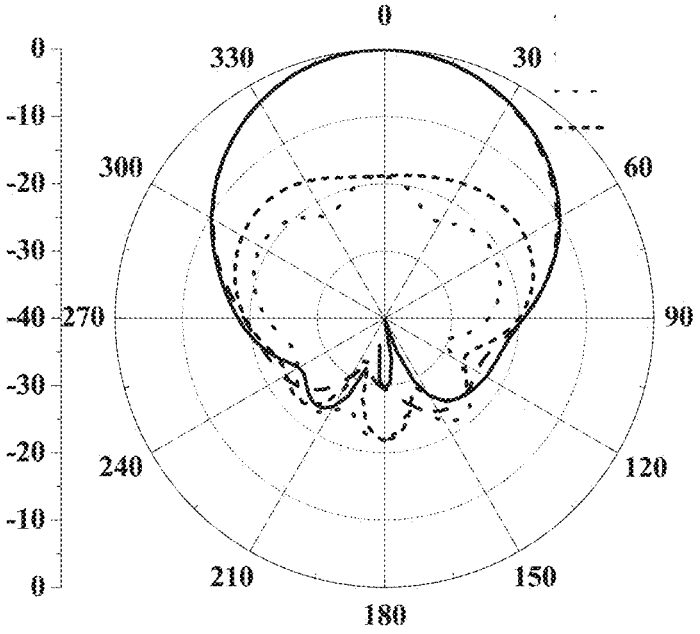

FIG. 17 illustrates a simulated standing wave ratio (SWR) and gain of an antenna (e.g., a wideband complementary antenna, a circularly polarized complementary antenna, etc.), as more fully disclosed herein. As illustrated by FIG. 17, the antenna can be associated with an impedance bandwidth of 31.6% for SWR<2 (from 53.2 to 73.2 GHz). As also illustrated by FIG. 17, antenna gain associated with the antenna can be varied between 7.2 and 9.1 dBic over an entire impedance bandwidth. FIG. 18 illustrates a simulated axial ratio and front-to-back ration of an antenna (e.g., a wideband complementary antenna, a circularly polarized complementary antenna, etc.), as more fully disclosed herein. As illustrated by FIG. 18, axial ration bandwidth associated with the antenna can be 24.4% (e.g., between 53.2 GHz and 68 GHz). As further illustrated by FIG. 18, a front-to-back ratio associated with the antenna can be larger than 17 dB over an entire operating band. FIG. 19 illustrates a simulated radiation pattern of an antenna (as disclosed herein) at 55 GHz, FIG. 20 illustrates a simulated radiation pattern of an antenna (as disclosed herein) at 60 GHz, and FIG. 21 illustrates a simulated radiation pattern of an antenna (as disclosed herein) at 65 GHz. As illustrated by FIGS. 19-21, a radiation pattern associated with the antenna can be symmetrical and stable at different frequencies over an entire operating band. As further illustrated by FIGS. 19-21, a cross polarization level associated with the antenna can be less than −15 dB.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A complementary antenna, comprising:

a first electrically conductive surface coupled to a dipole portion of the complementary antenna via a first group of electrically conductive pins formed within a first substrate associated with the dipole portion; and a second electrically conductive surface coupled to the first electrically conductive surface via a second group of electrically conductive pins formed within a second substrate.

2. The complementary antenna of claim 1, wherein the dipole portion is electrically excited via the second electrically conductive surface.

3. The complementary antenna of claim 1, wherein the dipole portion comprises a first dipole portion that is electrically coupled to a second dipole portion.

4. The complementary antenna of claim 3, wherein the first dipole portion comprises a first patch antenna portion and a second patch antenna portion.

5. The complementary antenna of claim 4, wherein the second dipole portion comprises a third patch antenna portion and a fourth patch antenna portion electrically coupled to the second patch antenna portion via a strip antenna portion.

6. The complementary antenna of claim 3, wherein the first group of electrically conductive pins comprises a first electrically conductive pin coupled to the first dipole portion and a second electrically conductive pin coupled to the second dipole portion.

7. The complementary antenna of claim 6, wherein first electrically conductive pin is separated from the second electrically conductive pin via an aperture etched on the first electrically conductive surface.

8. The complementary antenna of claim 1, wherein the first electrically conductive surface comprises an aperture etched on the first electrically conductive surface.

9. The complementary antenna of claim 1, wherein the first electrically conductive surface and the second electrically conductive surface comprise metallic surfaces.

10. The complementary antenna of claim 1, wherein the first electrically conductive surface and the second electrically conductive surface are separated by the second substrate that comprises the second group of electrically conductive pins.

11. The complementary antenna of claim 1, wherein the second electrically conductive surface is coupled to the first electrically conductive surface via an electrically conductive pin that matches an impedance associated with the dipole portion.

12. The complementary antenna of claim 1, further comprising a third electrically conductive surface coupled to the second electrically conductive surface via a third group of electrically conductive pins.

13. A system, comprising:

an antenna that comprises a dipole portion and a first set of conductive pins formed within a substrate layer associated with the dipole portion; and a substrate integrated waveguide that comprises a second set of conductive pins coupled to the antenna via an aperture etched on a conductive surface, wherein the second set of conductive pins is formed within the substrate integrated waveguide.

14. The system of claim 13, wherein the dipole portion comprises a first dipole portion that is electrically coupled to a second dipole portion.

15. The system of claim 14, wherein the first dipole portion comprises a first antenna portion and a second antenna portion, and wherein the second dipole portion comprises a third antenna portion and a fourth antenna portion attached to the second antenna portion via a fifth antenna portion.

16. The system of claim 14, wherein the conductive surface is coupled to the first dipole portion and the second dipole portion via the first set of conductive pins.

17. The system of claim 13, wherein the conductive surface is a first conductive surface, and wherein the first conductive surface is coupled to a second conductive surface via the second set of conductive pins.

18. An antenna system, comprising:

a first substrate that comprises patch antenna sections formed on a surface of the first substrate and first metal pins formed within the first substrate; and a second substrate that comprises second metal pins attached to the first substrate via a metal surface, wherein the second metal pins are formed within the second substrate.

19. The antenna system of claim 18, wherein the patch antenna sections are printed on the surface of the first substrate.

20. The antenna system of claim 18, wherein the metal surface is a first metal surface, and wherein the second metal pins are attached to a second metal surface.

* * * * *